US006061988A

United States Patent [19]

Parker

[11] Patent Number: 6,061,988

[45] Date of Patent: May 16, 2000

[54] BUILDING MODULE AND A METHOD OF CONSTRUCTING A WALL FROM SAID MODULE

[75] Inventor: William H. Parker, Sewickley, Pa.

[73] Assignee: BNZ Materials, Inc., Littleton, Colo.

[21] Appl. No.: 09/270,921

[22] Filed: Feb. 16, 1999

[51] Int. Cl.[7] ..... E04B 1/04; E04C 1/00; E04F 13/14

[52] U.S. Cl. ..... 52/604; 52/591.4; 52/609; 52/611

[58] Field of Search ..... 52/596, 604, 609, 52/611, 591.4

[56] References Cited

U.S. PATENT DOCUMENTS

| | | | |
|---|---|---|---|
| 621,100 | 3/1899 | Knowles | 52/611 |
| 2,538,059 | 1/1951 | Strunk | 52/604 |
| 5,160,215 | 11/1992 | Jensen | 52/611 X |

*Primary Examiner*—Christopher T. Kent
*Attorney, Agent, or Firm*—Robert S. Lipton, Esq.; Lipton, Weinberger & Husick

[57] ABSTRACT

A module, a wall made from said block, and a method of constructing a wall using such blocks, wherein the block has the general shape of a plus sign. The block is made from a first rectangular piece and a second rectangular piece joined perpendicular to said first rectangular piece. The blocks are assembled in a parquet fashion to construct a wall.

15 Claims, 8 Drawing Sheets

BUILDING MODULE AND A METHOD OF CONSTRUCTING A WALL FROM SAID MODULE

FIELD OF THE INVENTION

The present invention relates generally to building materials and, more specifically, to an interlocking module system for use as sidewall insulation.

BACKGROUND OF THE INVENTION

There are a number of industries that require a refractory wall. For example, industrial furnaces in which materials are treated at high temperatures, usually comprise a metal shell or a concrete outer wall that provides structural support for the entire furnace, a refractory wall positioned inside the structural metal shell or concrete outer wall, and a refractory back-up insulation wall located between the structural metal shell and the refractory wall.

A prior art refractory insulation wall is constructed from two common brick sizes. One "brick" size is a relatively large 3 feet L×4 feet W×18 inches D (length×width×depth) refractory concrete block, weighing 1,800 pounds. These 3'×4' blocks utilize tongue-and-groove joints for alignment. The construction of a prior art refractory insulation wall from these 3'×4' blocks requires the use of a crane, fork lift, or other mechanically-powered lifting apparatus for lifting the blocks and setting them in place. In addition, manpower is needed to precisely align the tongue of one 3'×4' block with the groove in an adjacent 3'×4' block. Finally, each 3'×4' block must be anchored to the structural metal shell or concrete outer wall.

The drawbacks of a refractory insulation wall constructed from the 3'×4' block is the requirement of a crane, the increased incidence of injury since one or more workers must help align the blocks during assembly, and the possibility of mismatching the blocks between courses (i.e., clearance required between the tongue and groove which is needed for proper installation makes it difficult to align and may require adjustment during and after assembly), and a system to anchor each block to the structural metal shell to maintain alignment and plumb.

The second brick size used to construct a refractory insulation wall is 9 inches L×4.5 inches W×either 2.5 inches or 3 inches D. The 9"L×4.5"W brick is more common than the aforementioned 3'×4' "brick" and is referred to as insulating fire brick (IFB). Refractory mortar is used to assemble a refractory insulation wall from the 9"×4.5" IFB.

The primary drawbacks of this second type of brick is the requirement of skilled masons to lay the IFB, the time needed to construct a wall, and the relatively higher cost associated with the skilled labor.

SUMMARY OF THE INVENTION

The present invention comprises an interlocking module system that utilizes relatively small pieces (e.g., 9"×18" and anywhere from about 5" to 18" deep) that are easily lifted and positioned by a single person. Depending on the thickness, each block weighs between approximately 12 to 80 pounds. Therefore, one person can assemble an entire wall by hand and a crane (or other mechanical machinery) is not needed.

The interlocking modules have cantilevered wings that are designed to be "locked" into place. The wings prevent the modules from passing through the wall towards the inside or outside, thus keyed in both directions. The subject modules form a stable wall even before they are mortared.

Although there are several methods of assembling the modules, a parquet manner is the preferred assembly process. This pattern leaves a central opening in the middle of every four modules.

BRIEF DESCRIPTION OF THE DRAWINGS

The accompanying drawings, which are incorporated in, and form a part of, the specification, illustrate embodiments of the present invention that are preferred at the time the application was filed and, together with the description, serve to explain the principals of the invention. It should be understood, however, that the invention is not limited to the precise arrangements and instrumentalities shown. In the drawings.

DETAILED DESCRIPTION OF THE PREFERRED EMBODIMENT

In describing the preferred embodiment of the present invention, specific terminology will be selected for the sake of clarity. However, the invention is not intended to be limited to the specific terms so selected, and it is to understood that each specific term includes all technical equivalents that operate in a similar manner to accomplish a similar purpose.

The terms "right", "left", "lower", "upper", "front", and "back" designate relative directions, when viewing the drawings, to which reference is made. The terms "inward" and "outward" refer to directions toward and away from, respectively, the interior of a four-walled room in which each wall is constructed of a plurality of modules in accordance with the present invention.

The preferred embodiment of the present invention will now be described in detail with reference to the accompanying drawings in which a primary building module is generally indicated at 10.

Figure 1:
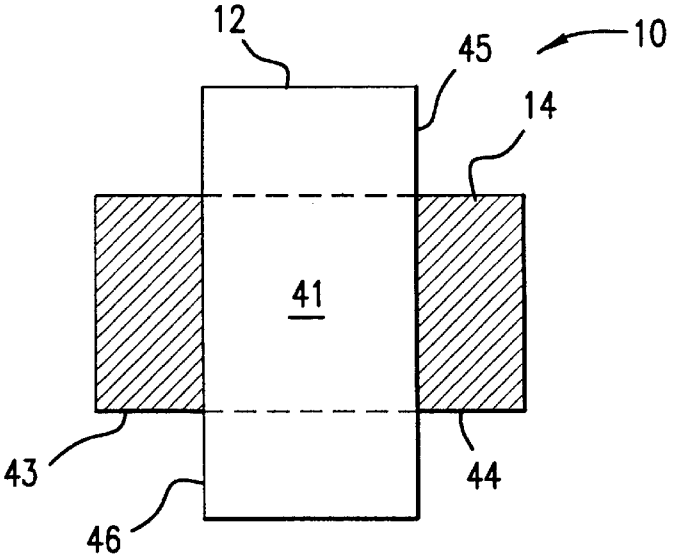
FIG. 1 is a front plan view of a primary building module in accordance with the present invention.

Referring now to FIG. 1, the general shape of a primary building module 10 is shown. The general shape may be described as a substantially cubic center portion 40 having a front surface 41, a rear surface 42, a first pair of diametrically opposed side surfaces (i.e., sometimes referred to as the left/right pair) and a second pair of diametrically opposed side surfaces (i.e., sometimes referred to as the top/bottom pair). A first pair 12 of cantilevered wings, (i.e., a left wing 43 and a right wing 44) extend outward from said first pair of diametrically opposed side surfaces of the cubical center and a second pair 14 of cantilevered wings (i.e., a top wing 45 and a bottom wing 46) extend outward from the second pair of diametrically opposed side surfaces of the cubical center. As illustrated in FIG. 1, the general shape of the primary building block is a "plus" sign with each axis in a separate but parallel plane.

As viewed from the front (as in FIG. 1) the length and width of the first and second pair of wings are substantially equal. The length of each wing is substantially equal to the length of a side of the cubic center portion. In the preferred embodiment, the width of each wing is one-half the length. For a cubic center portion having 9" sides, this yields a wing overhang of 4½".

The left wing 43 and the right wing 44 have substantially the same depth and are situated in the same plane. Similarly, the top wing 45 and the bottom wing 46 have substantially the same depth and are situated in the same plane. The second pair of cantilevered wings are in a substantially parallel plane to the plane of the first pair of cantilevered wings.

Figure 2:
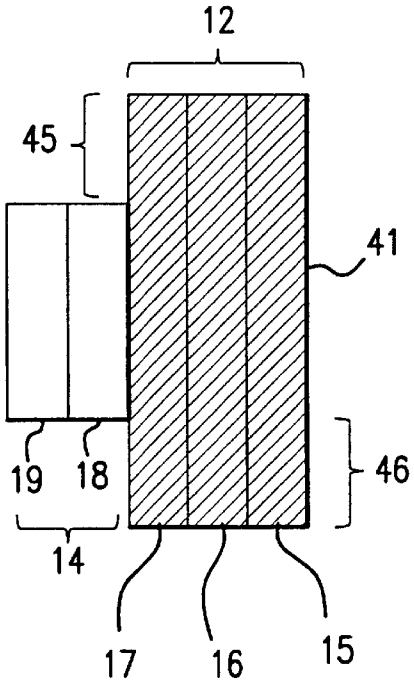
FIG. 2 is a left side view of the primary building module illustrated in FIG. 1, the right side being a mirror image thereof.
Figure 3:
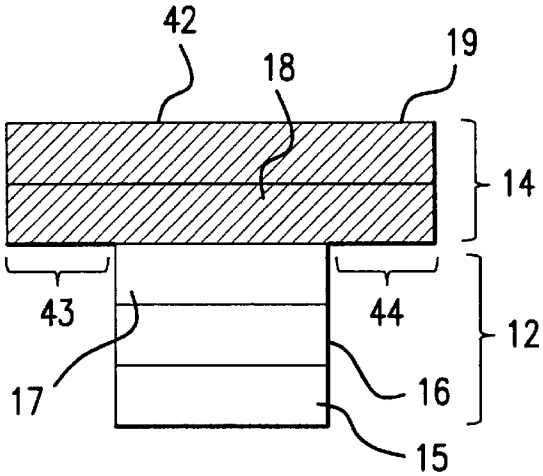
FIG. 3 is a top view of the primary building module illustrated in FIG. 1, the bottom view being a mirror image.

As illustrated in FIGS. 2 and 3, the depth of the first pair of wings (left and right) does not necessarily have to equal the depth of the second pair of wings (top and bottom). However, the combined depth of the first pair of wings and the second pair of wings is substantially equal to the depth of the cubic center portion 40.

Since each pair of diametrically opposed wings lies in a separate plane, they provide a module 10 that is keyed (or locked) in two directions; namely, toward the inside and toward the outside of a wall constructed from such modules. (In other words, a wall constructed from the present modules is secured in six directions, instead of the usual four directions such as walls constructed from "prior art" bricks.)

It should be noted that the manufacturing process is simplified if the module 10 is made from two generally rectangular blocks 12, 14 that are connected to each other at right angles (rather than attaching cantilevered wings to a central cubical portion). From the front, the module has what may be referred to as "plus sign" appearance; however, it will be recognized that the "arms" (i.e., the left/right pair of cantilevered wings) of the plus sign are in a separate plane from the "head and feet" (i.e., the top/bottom pair of cantilevered wings) of the plus sign.

In a preferred embodiment, the centers of the relatively large planar surfaces of each rectangular block lie on a straight line that is perpendicular to the planar faces of the remaining rectangular block. Also, the length to width ratio of each block is substantially identical and is preferably 2-to-1. In a preferred embodiment, the rectangular blocks are eighteen inches long and nine inches wide (this leaves a wing overhang of about 4½").

Figure 4:
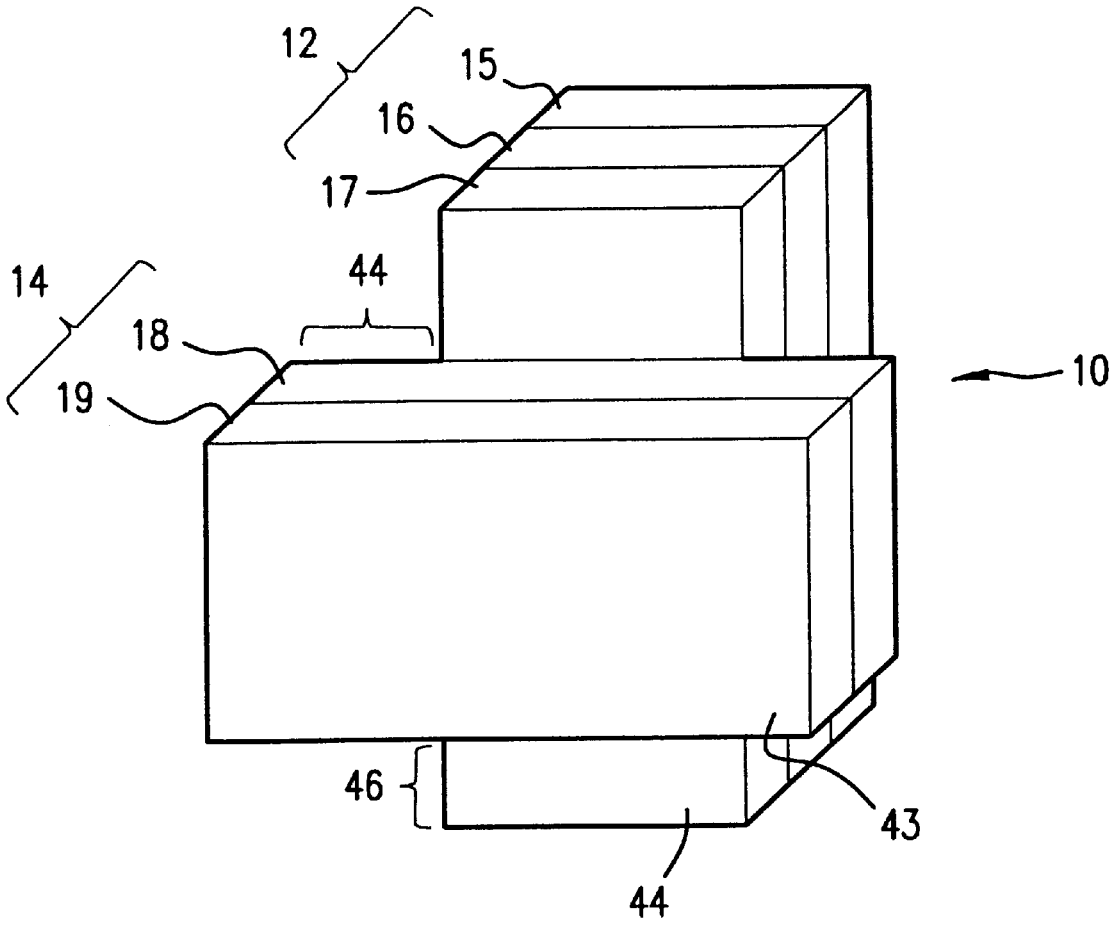
FIG. 4 is a back perspective view of the primary building module illustrated in FIG. 1.
Figure 4B:
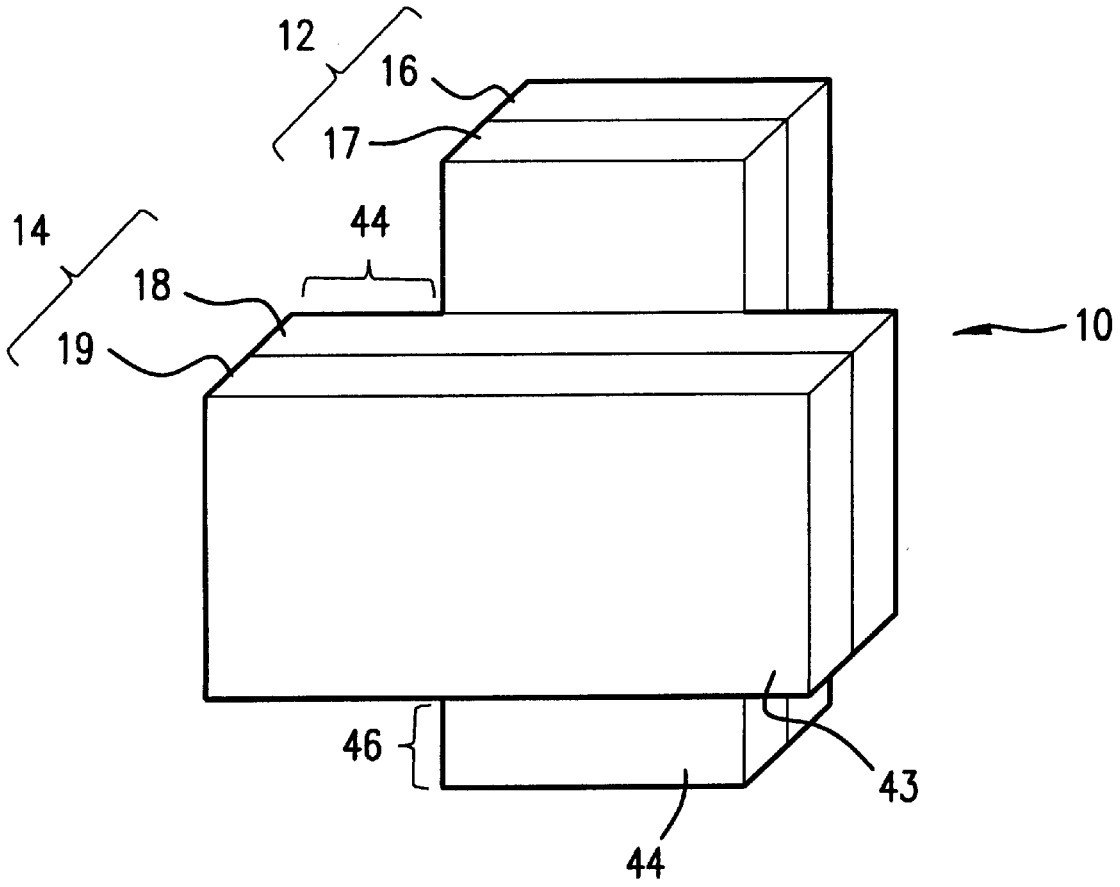
FIG. 4B is a back perspective view of a primary building module in which the front rectangular block has the same depth as the back rectangular block.

As illustrated in FIGS. 2, 3 and 4, each rectangular block may be comprised of a plurality of rectangular slabs mortared or cemented together. The mortar is heat resistent and acts like a high temperature glue. Although the slabs can be manufactured for any thickness; In order to reduce manufacturing costs a common thickness is usually chosen. In order to keep with industry standards, the slabs are preferably either 2½ inches or 3 inches thick. In addition, the grade of material may be varied for each rectangular block as the conditions of temperature and environment can be different through the wall thickness.

As can be seen in FIGS. 2 and 3, the "front" block 12 is comprised of three rectangular slabs 15, 16, 17, and the "rear" block 14 is comprised of two rectangular slabs 18, 19. Note that the terms "front" and "rear" are used instead of vertical and horizontal since the primary building module 10 is alternately rotated 90 degrees during the construction of a wall.

By utilizing a plurality of rectangular slabs to form each block, an important advantage is realized. First, the slabs can be conveniently shipped without taking up excessive space. The slabs or blocks can then be mortared together at the construction site. Second, each slab can be manufactured from a different grade of material as the conditions of temperature and environment warrant through the thickness of each block.

Slabs exposed to the inner surfaces (i.e., that are subject to the highest heat) can then be made from higher temperature materials, while the back slabs can be made from lower temperature materials. For example, for the three-slab front block, the front two slabs may be rated to withstand a temperature of 2600° F., and the third slab may be rated at 2500° F. The two-slab rear block may be rated to withstand a temperature of 2300° F. This has the advantage of utilizing lower cost materials for the rear blocks which also have better insulative qualities.

Figure 5:
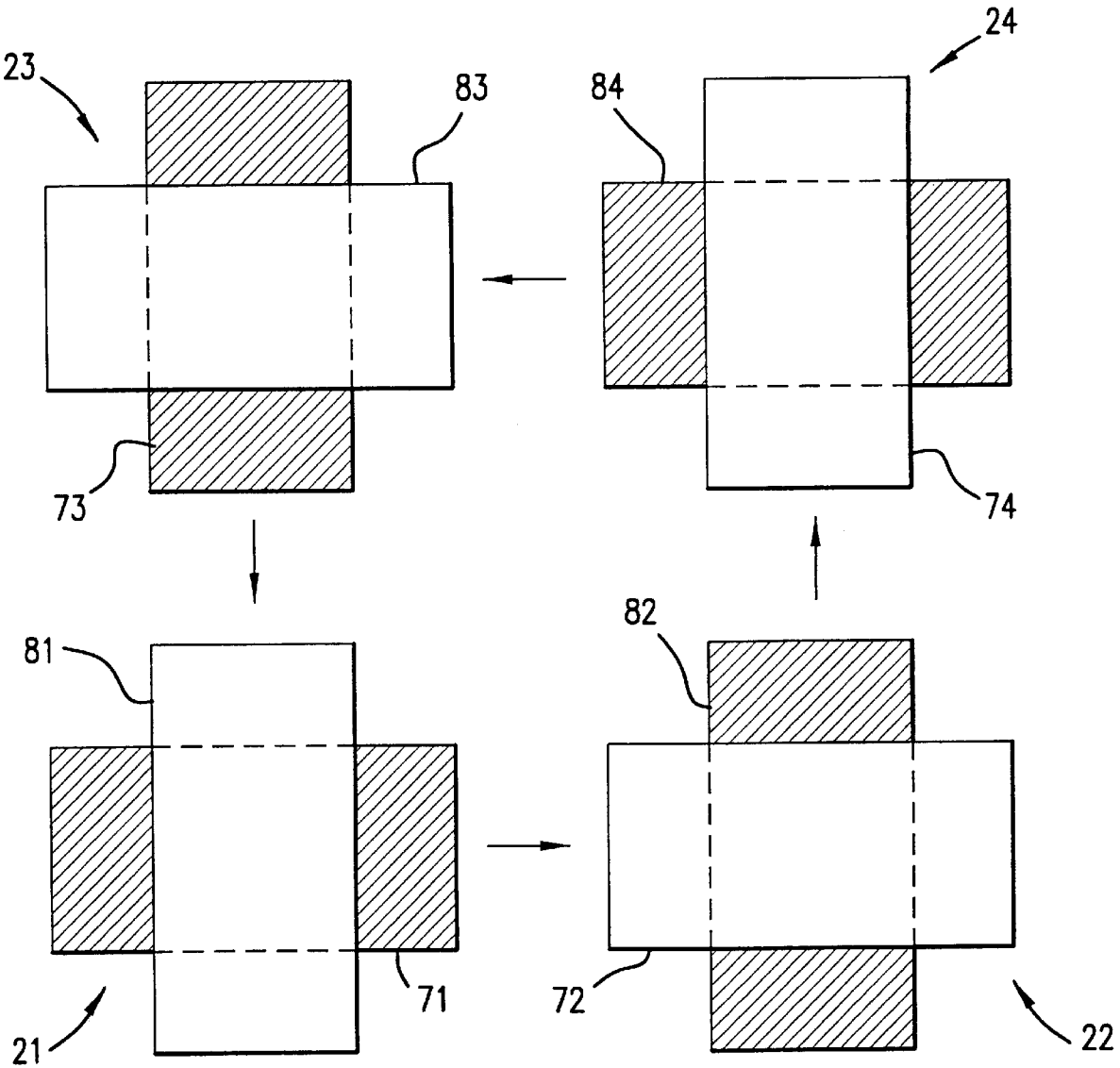
FIG. 5 is a front plan view of four primary building modules illustrating the basic method of assembly of a section of wall.

Referring now to FIG. 5, the primary method of interlocking four primary modules 21, 22, 23 and 24 will now be discussed. As will be shown, the modules are assembled in a parquet fashion so that a central module touches and communicates with four other modules. The four adjoining modules are rotated 90 degrees relative to the central module. (In the embodiment illustrated in the drawings, this always leaves three-slab blocks at the front of every module and two-slab blocks at the rear of every module.) Therefore, the front cantilevered wings of one module overlap the back cantilevered wings of its neighbors and vice versa. Note that the horizontal or left/right pair of wings of one module are in the front, while the horizontal or left/right pair of wings of the immediately adjacent modules are in the rear.

As illustrated in FIG. 5, the vertical wings of the first module 21 and the fourth module 24 lie in a plane "closer" to the observer than their horizontal wings. (Although the first and fourth modules are given separate reference numbers, it should be noted that they are substantially identical. Similarly, the second and third modules are substantially identical.) In contrast, the top and bottom wings of the second and third modules 22, 23 lie in a plane that is "farther away" from the observer than the left and right wings. Note that, in FIG. 5, the shaded portions are the rear blocks (i.e., located further away from an observer) while the non-shaded portions represent blocks that are in the front (i.e., located closer to the observer).

Since the depth of each module is virtually identical, the top and bottom wings of the first and fourth modules 21, 24 lie in the same plane as the left and right wings of second and third modules 22, 23; similarly, the left and right wings of the first and fourth modules 21, 24 lie in the same plane as the top and bottom wings of the second and third modules 22, 23.

The specifics of a wall assembly will now be described in detail with reference to FIGS. 5, 6 and 7*a*–7*d*. The right wing 71 of the first module 21 is overlaid by the left wing 72 of the second module 22; the top wing 81 of the first module 21 overlays the bottom wing of the third module 23.

Similarly, the bottom wing 74 of the fourth module 24 overlays the top wing 82 of the second module 22, while simultaneously the right wing 83 of the third module 23 overlays the left wing 84 of the fourth module 24.

Figure 6:
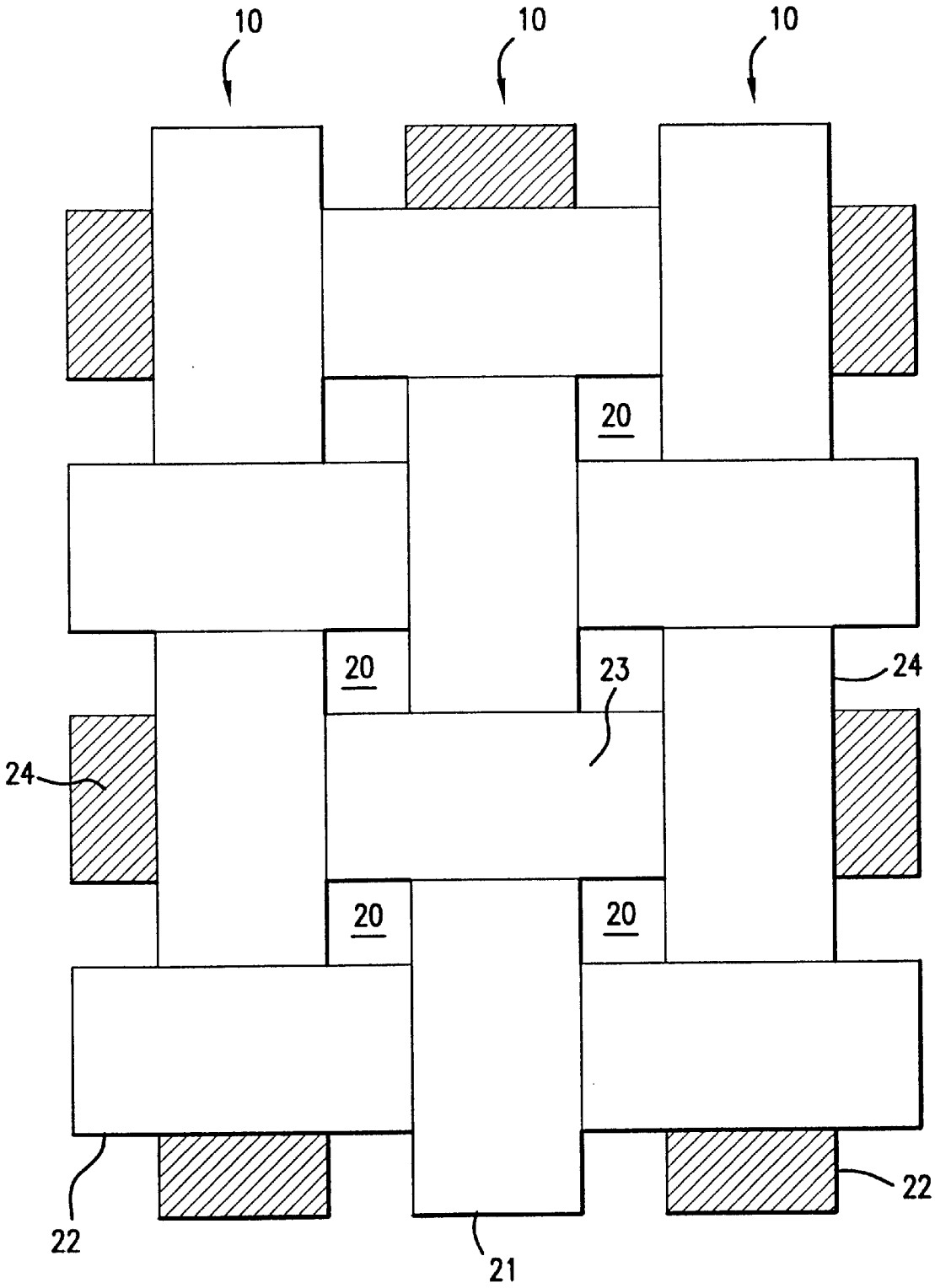
FIG. 6 is a front plan view of a wall section assembled from twelve primary building modules interlocked in accordance with the present invention.

As illustrated in FIG. 6, twelve primary building modules 10 have been fitted together. By continuing to add primary modules in this manner, a lattice or parquet-type wall structure forms. (See FIG. 8.)

As a result of the deliberate wing overlay arrangement described above, in the middle of every set of four modules is a center opening 20. In the preferred embodiment, the width of the top/bottom pair of wings (i.e., the overhang from the cubic center portion) is equal to the width of the left/right pair of wings; therefore, the shape of the center opening 20 is a square. In fact, in each case where the width of the front and rear wings are equal, the shape of the center opening will be square.

If the left/right pair of wings of each module are wider (i.e., the overhang from the cubical center portion is greater) than the top/bottom pair of wings, a rectangularly-shaped center opening, having a horizontal longitudinal dimension, is formed when a wall assembly is constructed. If the top/bottom pair of wings of each module are wider than the left/right pair of wings, a rectangularly-shaped center opening, having a vertical longitudinal dimension, is formed when a wall assembly is constructed. Note that when the top/bottom pair's wing-length equals the left/right pair's wing-length, only one "basic" module needs to be manufactured in order to produce a wall (even if the thickness of the left/right pair of wings is different than the thickness of the top/bottom pair of wings). During the assembly of a wall section, this one module is rotated 90 degrees, as required, to overlap the appropriate wings.

If the depth of the left/right pair of wings is equal to the depth of the top/bottom pair of wings, then once again, only a single module is needed—even if the overall width of the left/right pair of wings is not equal to the overall width of the top/bottom pair of wings. In order to build a wall, alternating modules are not only rotated 90 degrees, but they are flipped over so that the back side is the front side and vice versa. However, if the overall depth of the left/right pair of wings is not equal to the overall depth of the top/bottom pair of wings, then two separate modules must be manufactured in order to construct a wall.

Each center opening 20 (whether square or rectangular) is filled in by one or more pieces of refractory filler brick that are appropriately sized. Note that the center openings between each group of four primary modules 10 are substantially identical; therefore, the filler bricks can be standardized.

The length of the filler bricks depends on the number and the thickness of the slabs 15–19. In a preferred embodiment (i.e., where each wing extends 4½ inches from its respective cubic center portion 40), the center opening 20 is approximately 4½"×4½" and two standard-sized bricks (one 13½"×4½"×3" and a second 13½"×4½"×1½") are inserted and cemented into the central openings.

In order to construct a self-standing wall section, several secondary modules (resembling truncated primary modules illustrated in FIG. 1) are required. One shape is for placement in a corner of the wall and the other shape is for placement along the edge of the wall. Most structures, such as a carbon bake, utilize piers (usually made from standard refractory brick) at the end of each wall section so no corner interlock is needed.

Figure 7A:
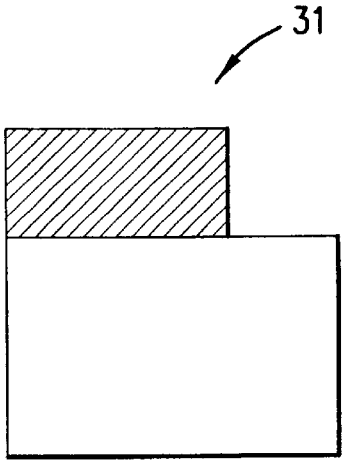
FIG. 7*a*–7*d* are front plan views of secondary modules needed to construct a wall.
Figure 7B:
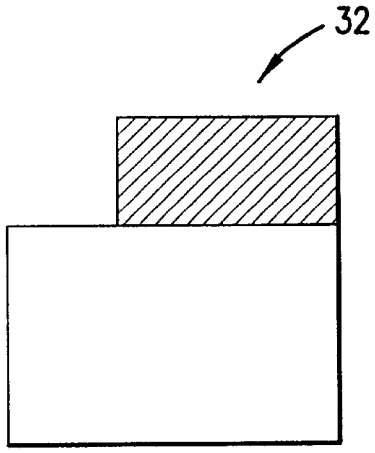
Figure 7C:
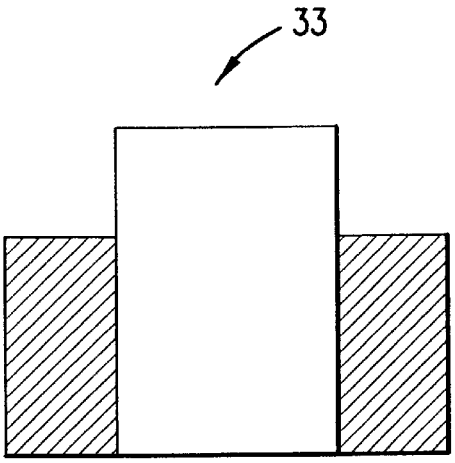
Figure 7D:
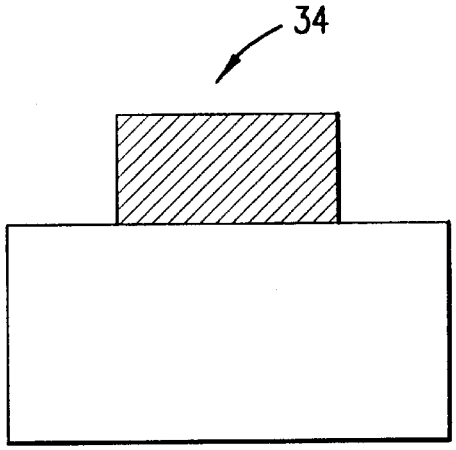

If the front block of a module has the same number of rectangular slabs as the rear block, only two additional secondary modules are required to construct a wall. However, in the illustrated example of FIGS. 1, 2 and 3, in which the front block contains three rectangular slabs and the rear block contains two rectangular slabs, four secondary modules are required; namely:

A) a bottom left hand corner module 31 (which can also be used as an upper right corner module) in which the left portion of the front block is trimmed off and the bottom portion of the rear block is trimmed off (see FIG. 7*a*);

B) a bottom right hand corner module 32 (which can also be used as an upper left hand corner module) in which the bottom of the front block is trimmed off and the right hand portion of the rear block is trimmed off (see FIG. 7*b*);

C) a first edge module 33 in which only a portion of the front block is trimmed off (see FIG. 7*c*); and D) a second edge module 34 in which only a portion of the rear block is trimmed off (see FIG. 7*d*).

Referring now to FIGS. 7*a–d* and 8, starting from a bottom left hand corner, the right wing of the corner module 31 overlays the left wing of a first edge module 33; the left wing of a second edge module 34 overlays the right wing of the first edge module 33. The bottom course of modules continues to alternate first and second edge modules until the general length of the wall is reached and then a bottom right-hand corner module 32 is used to finish the corner of the wall (or to tie into a pier). Above the bottom right hand corner module, a second edge module 34 is placed. The primary modules 10 can now start to be laid in the order described previously.

Figure 8:
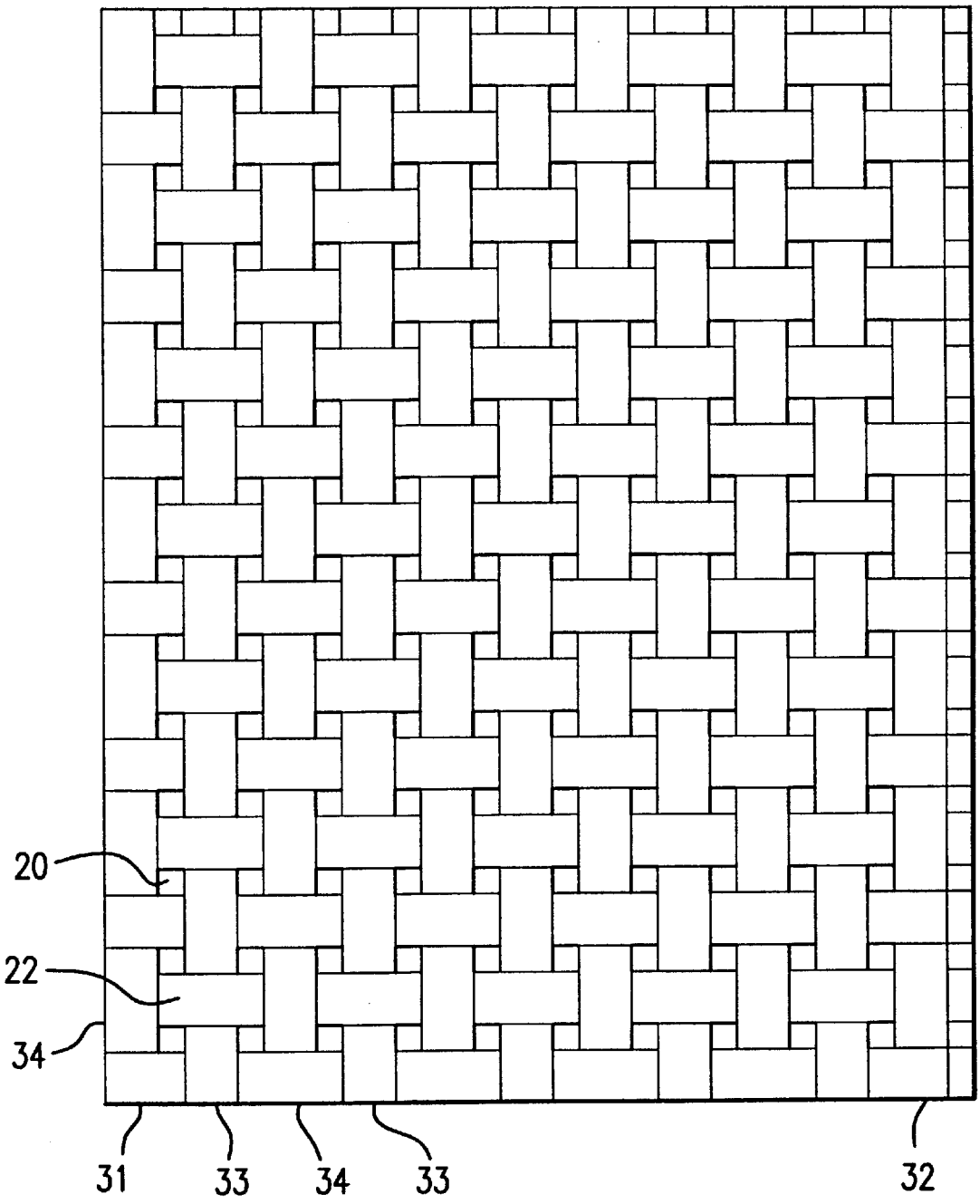
FIG. 8 is a complete wall section assembled from primary and secondary modules.

The wall is continued to be formed in this fashion until the proper height and width of the wall are formed (see FIG. 8). Mortar is preferably used to permanently secure each module into place. The mortar is usually applied between the modules as the wall is being assembled. The mortar joints are typically about one millimeter thick between the modules.

The modules are assembled in a parquet fashion to construct a wall wherein each group of four modules leaves a central opening. The overlapping wings also prevent block movement both inwards and outwards (in addition to horizontal and vertical). This results in a double-key interlocking block system that forms a stable wall even without the mortar.

In prior art brick walls, each brick is secured by its surrounding bricks. However, there is nothing that keeps the prior art brick from moving inward or outward (other than the adhesiveness of the mortar).

Figure 9:
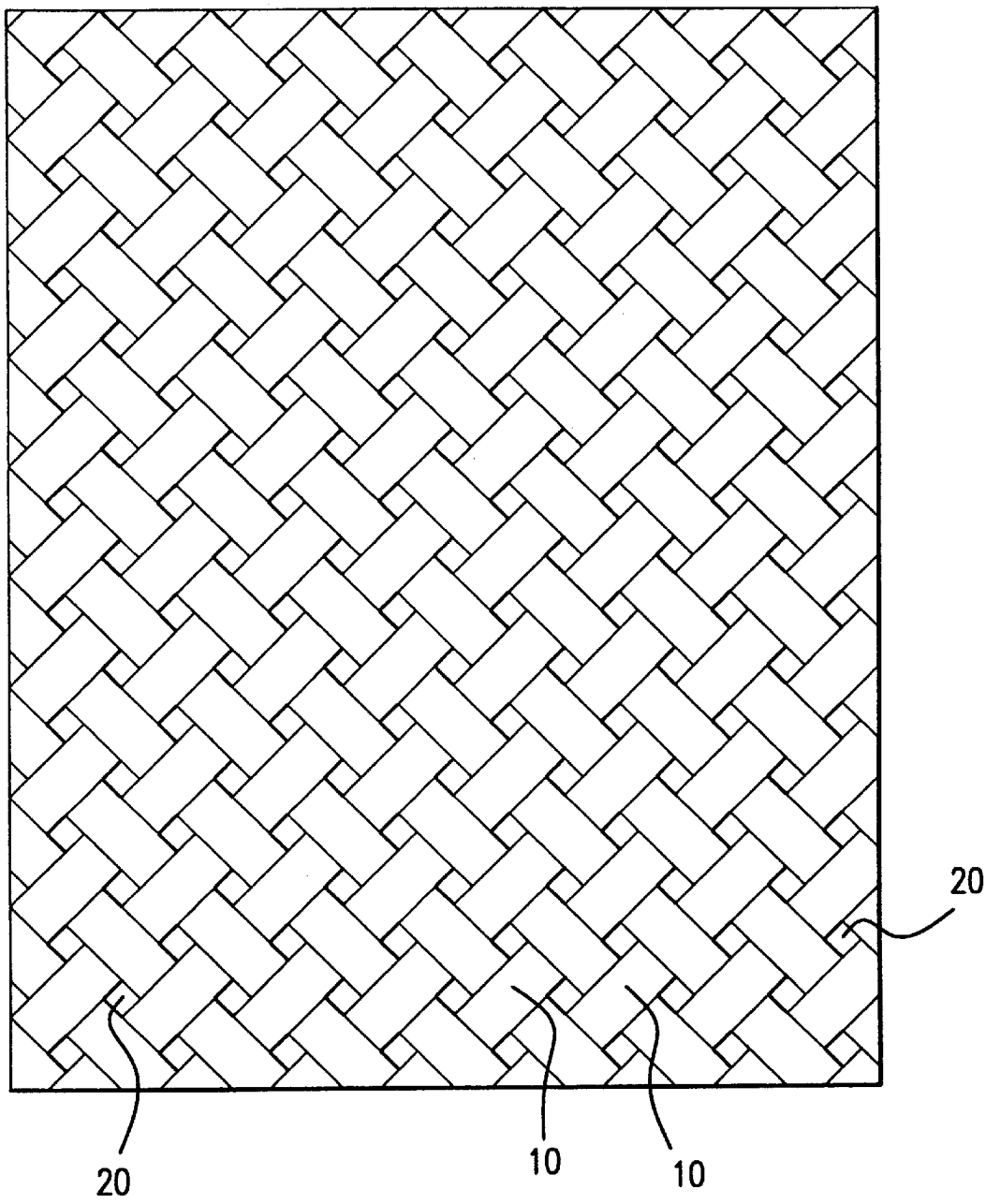
FIG. 9 is a "diagonal" variation of a wall assembled from primary modules and a different set of secondary modules in accordance with the present invention.

Another wall, in accordance with the present invention is illustrated in FIG. 9. This alternate embodiment (sometimes referred to as a diagonal wall) employs the same primary modules 10 as described above and interlocked in the same manner; however, the first course of corner modules and edge modules are different than the secondary edge modules illustrated in FIGS. 7*a–d*. (The modules are rotated 45 degrees and appear to have an "X" shape, as opposed to a "+" shape, in this embodiment.)

As can be seen, the central openings 20 are still produced. After the wall section is formed, the filler bricks are inserted and mortared into each of the rectangular openings 20 thereby forming a solid wall.

The subject rectangular slabs are primarily made of clay and other ceramic raw materials, so they will shrink after being fired. However, each slab is made slightly larger than required, so that after they have dried they can be machined or cut to the desired size.

The modules (or preferably the rectangular slabs that are combined to form a module) may also be made from a refractory material which is used in high temperature applications. The refractory material is usually made from clay, metal oxides (e.g., calcium dioxide, alumina oxide, magnesium oxide or silica dioxide), or other ceramic raw materials (e.g., silicon carbide, aluminum nitride, carbon, silicon-aluminum oxynitride). It should be noted though that the shape of the blocks and the techniques used for assembly of the wall section could be used for general construction and other applications.

An important feature of the present invention is the method of interlocking the primary blocks with each other, leaving the central opening. Although the inventor is aware of other methods of joining the modules together that form different patterns (including at least one "tight" configuration wherein no central openings are formed), there are unique advantages for producing walls in accordance with the preferred embodiment illustrated in the accompanying drawings.

By proceeding with a tight configuration, there is essentially zero clearance between each module. In this configuration, part of each module is required to fit into a space of nearly its exact size (i.e., there is zero clearance between modules). Therefore, not only does this make it difficult to assemble a wall section, the application of mortar between the modules exacerbates this assembly problem. Also, two or more people may be needed to jiggle or move surrounding modules, in order to squeeze in an adjacent module. This increases the amount of time needed to construct a wall, and the likelihood that pieces of modules will be broken off during assembly of the wall and possibly requiring the replacement of modules that were previously set.

In the preferred embodiment, the central openings allow more "play" between adjacent blocks during assembly; however, the interlocking wings produces a finished wall that is extremely sturdy. The parquet section allows easy application of mortar as no "zero clearance" assembly is required. Also, a single person can build a parquet wall without help from others.

It should be noted, however, that to reduce shipping volume, the subject modules may be arranged in any desired manner. Also, it may be preferable to ship the rectangular slabs to the desired destination and then construct the primary and secondary building modules on site.

Although the invention has been shown and described with respect to a particular embodiment, it is to be understood that variations may be made which come within the scope of the invention.

I claim:

1. A module for use in a planar support section, comprising:

a first generally rectangular block having a length, width and depth; and a second generally rectangular block having a length, width and depth, said second rectangular block joined substantially perpendicular to said first rectangular block and said depth of the first rectangular block being a different dimension than said depth of the second rectangular block.

2. The module of claim 1 wherein both blocks are joined at substantially their center points of their largest planar surface.

3. The module of claim 2 wherein the largest planar surfaces of both rectangular blocks have a length to width ratio of 2 to 1.

4. The module of claim 3 wherein the largest planar surfaces of both rectangular blocks have a length of 9 inches and a width of 4½ inches.

5. The module of claim 3 wherein the largest planar surfaces of both rectangular blocks have a length of 18 inches and a width of 9 inches.

6. The module of claim 4 wherein the depth of the first block is 5 inches and the depth of the second block is 7½ inches.

7. The module of claim 2 wherein both blocks are comprised of refractory material.

8. A module for constructing a wall section comprising:

a substantially cubical center portion having a front surface, a rear surface, a left side surface, a right side surface, a top side surface and a bottom side surface;

a first pair of diametrically opposed cantilevered wings extending outward from said left/right side surfaces of said cubical center, said first pair of wings having a first depth dimension; and a second pair of diametrically opposed cantilevered wings extending outward from said top/bottom side surfaces of said cubical center, an axis through said second pair of wings being substantially perpendicular to but in a different plane than an axis through said first pair of wings, said second pair of wings having a depth dimension different than said depth dimension of the first pair of wings, with the combined depth of the first and second pair of wings equal to the depth of said cubical center portion; and said first pair of wings positioned so that one of its surfaces is substantially planar to said front surface of the cubical center portion; and said second pair of wings positioned so that one of its surfaces is substantially planar to said rear surface of the cubical center portion.

9. A wall comprised of:

a plurality of modules having the shape of two generally rectangular blocks, each block having a different depth dimension, said blocks being perpendicularly joined together to resemble a plus sign having a first pair of wings and a second pair of wings cantilevered from a central portion, wherein the first pair of wings are positioned in a first plane and the second pair of wings are positioned in a second plane parallel to the first plane and at a different elevation.

10. The wall of claim 9 wherein said modules are assembled in a parquet fashion forming regularly spaced central openings.

11. The wall of claim 10 wherein said central openings are square shaped.

12. The wall of claim 9 wherein said modules are interlocked together with at least a portion of the wings from said first pair of wings of a first module are overlaid over an equal number of wings from said second pair of wings of adjacent modules.

13. A wall comprised of:

a plurality of interlocking modules, each module having the shape of two generally rectangular blocks perpendicularly joined together to resemble a plus sign having first and second pair of wings cantilevered from a central portion; the first pair of wings being positioned in a first plane and the second pair of wings being positioned in a second plane parallel to the first plane but at a different elevation, said first wings of one module overlapping the second wings of two diametrically opposed and adjacent modules and said second wings of said first module lapping behind the first wings of two other diametrically opposed and adjacent modules; said wings abutting against the edges of the central portion of adjacent modules forming a parquet arrangement having central openings located between the central portions of the modules.

14. The wall of claim 13 wherein each rectangular block has the same depth dimension.

15. The wall of claim 13 wherein each rectangular block has a different depth dimension.

* * * * *